US010577736B2

(12) United States Patent
Hara et al.

(10) Patent No.: US 10,577,736 B2
(45) Date of Patent: Mar. 3, 2020

(54) EMBROIDERY DATA GENERATING APPARATUS, EMBROIDERY DATA GENERATING METHOD, AND PROGRAM FOR EMBROIDERY DATA GENERATING APPARATUS

(71) Applicant: JANOME SEWING MACHINE CO., LTD., Tokyo (JP)

(72) Inventors: Kenji Hara, Tokyo (JP); Takeshi Shinomiya, Tokyo (JP)

(73) Assignee: JANOME SEWING MACHINE CO., LTD., Tokyo (JP)

( * ) Notice: Subject to any disclaimer, the term of this patent is extended or adjusted under 35 U.S.C. 154(b) by 79 days.

(21) Appl. No.: 15/956,844

(22) Filed: Apr. 19, 2018

(65) Prior Publication Data

US 2018/0371661 A1 Dec. 27, 2018

(30) Foreign Application Priority Data

Jun. 23, 2017 (JP) ..... 2017-123198

(51) Int. Cl.

| | |
|---|---|
| ***D05C 5/02*** | (2006.01) |
| ***D05B 19/10*** | (2006.01) |
| ***D05B 19/12*** | (2006.01) |
| ***D05C 5/06*** | (2006.01) |
| ***D05B 11/00*** | (2006.01) |

(52) U.S. Cl.

CPC ..... *D05C 5/02* (2013.01); *D05B 11/00* (2013.01); *D05B 19/10* (2013.01); *D05B 19/12* (2013.01); *D05C 5/06* (2013.01)

(58) Field of Classification Search

CPC ..... D05C 5/02; D05B 19/08; D05B 19/10; D05B 19/12; D05B 19/14; D05B 19/169

See application file for complete search history.

(56) References Cited

U.S. PATENT DOCUMENTS 4,429,364 A * 1/1984 Maruyama ..... D05B 19/08 112/445
5,005,500 A * 4/1991 Kato ..... D05B 19/08 112/102.5

(Continued)

FOREIGN PATENT DOCUMENTS

JP 3589799 B2 11/2004

*Primary Examiner* — Nathan E Durham
(74) *Attorney, Agent, or Firm* — Nakanishi IP Associates, LLC

(57) ABSTRACT

An embroidery data generating apparatus includes: a coordinate position registration unit that registers coordinate positions of multiple track points detected at predetermined intervals from a track of a continuous line input via a screen, with them associated with a track point input order; a reference distance registration unit that registers a stitching pitch length as a reference distance; and an embroidery data generating unit configured to generate a desired track point on the continuous line as a needle location start point, to select particular track points that are subsequently input from among the multiple track points as reference track points, to convert the coordinate positions of the reference track points to arrange them in input order from the needle location start point at intervals of the reference distance, to generate the converted points as needle location points, and to generate data of the generated needle location points as embroidery data.

7 Claims, 9 Drawing Sheets

(56) References Cited

U.S. PATENT DOCUMENTS

| | | | | | |
|---|---|---|---|---|---|
| 5,357,442 | A * | 10/1994 | Sekine | D05B 19/10 | 112/102.5 |
| 5,740,056 | A * | 4/1998 | Futamura | D05B 19/08 | 112/456 |
| 8,074,590 | B2 * | 12/2011 | Bentley | D05B 11/00 | 112/470.01 |
| 2007/0129840 | A1 * | 6/2007 | Nobuyuki | D05B 19/10 | 700/138 |
| 2007/0144418 | A1 * | 6/2007 | Asano | D05B 19/08 | 112/102.5 |

* cited by examiner

| ITEM | COORDINATE POSITION (pixel) | |
|---|---|---|
| | X | Y |
| TS | 23.3 | 78.6 |
| TC(1) | 30.9 | 65.2 |
| TC(2) | 43.7 | 56.7 |
| ··· | | |
| TE | 134.6 | 22.8 |

FIG. 3A
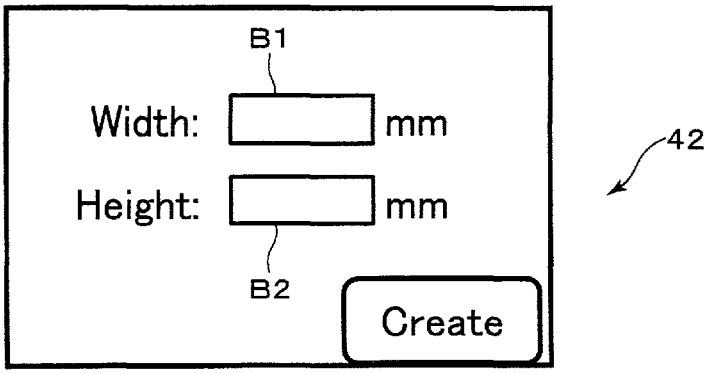
FIG. 3B
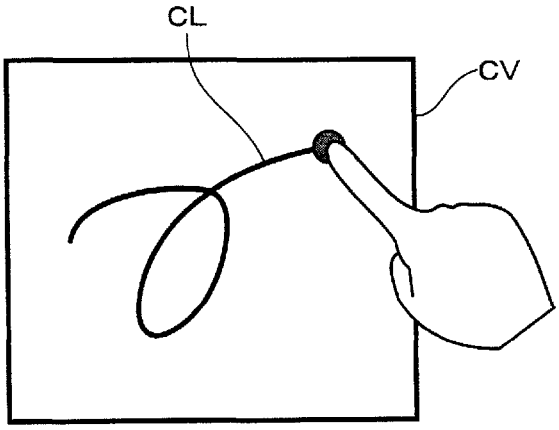
FIG. 3C
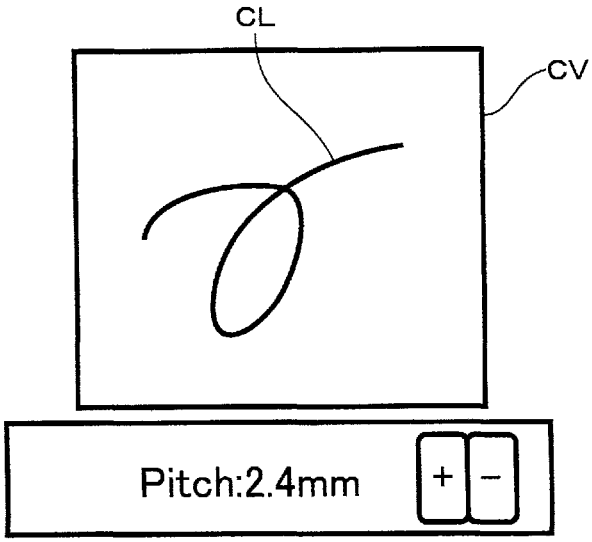
FIG.3

| ITEM | COORDINATE POSITION (pixel) | |
|---|---|---|
| | X | Y |
| A(1) | 23.3 | 78.6 |
| A(2) | 24.6 | 72.3 |
| A(3) | 27.3 | 67.8 |
| A(4) | 32.6 | 62.1 |
| A(5) | 39.1 | 58.0 |
| A(6) | 46.6 | 54.8 |
| A(7) | 54.8 | 52.6 |
| A(8) | 62.8 | 51.8 |
| A(9) | 70.6 | 51.8 |
| A(10) | 78.0 | 54.3 |
| A(11) | 84.0 | 58.5 |
| A(12) | 88.0 | 65.0 |
| A(13) | 89.6 | 73.3 |
| ... | | |
| A(E) | 134.6 | 22.8 |

EMBROIDERY DATA GENERATING APPARATUS, EMBROIDERY DATA GENERATING METHOD, AND PROGRAM FOR EMBROIDERY DATA GENERATING APPARATUS

BACKGROUND OF THE INVENTION

1. Field of the Invention

The present invention relates to an embroidery data generating apparatus, an embroidery data generating method, and a program employed in the embroidery data generating apparatus.

2. Description of the Related Art

An embroidery data generating apparatus described in Patent document 1 listed below is configured to read out image data, and to generate stitch data based on the image data thus read out. Specifically, the embroidery data generating apparatus generates skeletonized data that represents the skeleton of the image. Furthermore, for an image unit having a length that is shorter than a predetermined length, the embroidery data generating apparatus generates outline data that represents the outline of the image unit. The embroidery data generating apparatus generates stitch data based on the skeletonized data or otherwise the outline data. The selection of the data to be used to generate the stitch data is made based on whether or not the length of the image unit is longer than the reference length. This allows the embroidery data to be generated without damaging the original image.

RELATED ART DOCUMENTS

Patent Documents

[Patent Document 1]

Publication of Japanese Patent No. 3589799

However, there is room for further improvement in the aforementioned embroidery data generating apparatus from the following viewpoint. That is to say, the embroidery data generating apparatus generates the embroidery data based on the image data thus read out. Accordingly, in a case in which there are crossing lines in the image, the embroidery data generating apparatus is not capable of judging the hierarchical relationship between such lines in the crossing portion. In other words, the embroidery data generating apparatus is not capable of judging which line is to be arranged as an upper-side line. Accordingly, in some cases, such an embroidery data generating apparatus is not capable of providing an embroidery as intended by the user. Thus, there is room for improvement in the aforementioned embroidery data generating apparatus from this viewpoint.

Giving consideration to the aforementioned fact, it is a purpose of the present intention to provide an embroidery data generating apparatus, an embroidery data generating method, and a program for an embroidery data generating apparatus, in order to provide an embroidery as intended by the user.

SUMMARY OF THE INVENTION

[Embodiment 1]

At least one embodiment of the present invention proposes an embroidery data generating apparatus configured to generate needle location points for forming a stitching pattern based on an input continuous line. The embroidery data generating apparatus comprises: a coordinate position registration unit that registers coordinate positions of multiple track points detected at predetermined intervals from a track of a continuous line input via a screen, such that they are associated with an input order of the track points; a reference distance registration unit that registers a stitching pitch length as a reference distance; and an embroidery data generating unit configured to generate a desired one of the track points on the continuous line as a needle location start point which is a start point of a needle location, to select particular track points as reference track points from among the multiple track points that have been input after the track point thus generated as the needle location start point, to convert the coordinate positions of the reference track points such that the reference track points are arranged in the input order from the needle location start point at intervals of the reference distance, to generate the converted points as needle location points, and to generate data of the needle location points thus generated as embroidery data.

[Embodiment 2]

At least one embodiment of the present invention also proposes the embroidery data generating apparatus. The embroidery data generating unit sets the needle location start point as a reference point, and registers a distance between the reference point and each of the track points in a registration order of the track points. The embroidery data generating unit selects, as the reference track point, a first one of the track points when the distance becomes longer than the reference distance or otherwise the track point that is immediately before the first track point. The embroidery data generating unit generates, as the needle location point, a particular point on an imaginary line defined such that it extends from the reference point up to the reference track point such that the particular point is positioned away from the reference point by the reference distance. The embroidery data generating unit sets the needle location point thus generated as the updated reference point, and repeatedly generates the subsequent needle location points.

[Embodiment 3]

At least one embodiment of the present invention also proposes the embroidery data generating apparatus. The embroidery data generating unit sets the needle location start point as a reference point, and registers a distance between the reference point and each of the track points in a registration order of the track points. The embroidery data generating unit selects, as a first reference track point, a first one of the track points when the distance between the reference point and the track point becomes longer than the reference distance, and selects, as a second reference track point, a track point that is immediately before the first reference track point. The embroidery data generating unit acquires, as a first candidate point, a particular point on a first imaginary line defined such that it extends from the reference point up to the first reference track point such that the particular point is positioned away from the reference point by the reference distance, and calculates a first candidate distance between the first reference track point and the first candidate point. The embroidery data generating unit acquires, as a second candidate point, a particular point on a second imaginary line defined such that it extends from the reference point up to the second reference track point such that the particular point is positioned away from the reference point by the reference distance, and calculates a second candidate distance between the second reference track point and the second candidate point. When the first candidate distance is shorter than the second candidate distance, the embroidery data generating unit generates the first candidate point as the needle location point. When the second candidate distance is shorter than the first candidate distance, the embroidery data generating unit generates the second candidate point as the needle location point. The embroidery data generating unit sets the needle location point thus generated as the updated reference point, and repeatedly generates the subsequent needle location points.

[Embodiment 4]

At least one embodiment of the present invention also proposes the embroidery data generating apparatus. The embroidery data generating apparatus comprises a display unit including the screen configured to allow the continuous line to be input, and configured to set a size of a canvas via which the continuous line is input according to an operation. When the second candidate point is arranged at a position outside the canvas, the first candidate point is generated as the needle location point.

[Embodiment 5]

At least one embodiment of the present invention also proposes the embroidery data generating apparatus. The coordinate position registration unit registers a start point of the continuous line as the first track point, and registers an end point of the continuous line as the last track point. The embroidery data generating unit generates the first track point as the needle location start point, and generates the last track point as the needle location end point which is an end point of the needle location.

[Embodiment 6]

At least one embodiment of the present invention also proposes the embroidery data generating apparatus. The kind of the predetermined intervals is at least one from among a predetermined time and a predetermined distance.

[Embodiment 7]

At least one embodiment of the present invention proposes an embroidery data generating method for generating needle location points for forming a stitching pattern based on an input continuous line. The embroidery data generating method comprises: registering in which a coordinate position registration unit registers coordinate positions of multiple track points detected at predetermined intervals from a track of a continuous line input via a screen, such that they are associated with an input order of the track points; registering in which a reference distance registration unit registers a stitching pitch length as a reference distance; and generating in which an embroidery data generating unit generates a desired one of the track points on the continuous line as a needle location start point which is a start point of a needle location, selects particular track points as reference track points from among the multiple track points that have been input after the track point thus generated as the needle location start point, converts the coordinate positions of the reference track points such that the reference track points are arranged in input order from the needle location start point at intervals of the reference distance, generates the converted points as needle location points, and generates data of the needle location points thus generated as embroidery data.

[Embodiment 8]

At least one embodiment of the present invention proposes a non-transitory recording medium that stores a program to be used to instruct a computer of an embroidery data generating apparatus configured to generate needle location points for forming a stitching pattern based on an input continuous line, to execute: registering in which a coordinate position registration unit registers coordinate positions of multiple track points detected at predetermined intervals from a track of a continuous line input via a screen, such that they are associated with an input order of the track points; registering in which a reference distance registration unit registers a stitching pitch length as a reference distance; and generating in which an embroidery data generating unit generates a desired one of the track points on the continuous line as a needle location start point which is a start point of a needle location, selects particular track points as reference track points from among the multiple track points that have been input after the track point thus generated as the needle location start point, converts the coordinate positions of the reference track points such that the reference track points are arranged in input order from the needle location start point at intervals of the reference distance, generates the converted points as needle location points, and generates data of the needle location points thus generated as embroidery data.

With the embroidery data generating apparatus, the embroidery data generating method, and the program for the embroidery data generating apparatus, such an arrangement is capable of generating embroidery data for providing an embroidery according to a design as intended by the user.

BRIEF DESCRIPTION OF THE DRAWINGS

FIG. 3A is a schematic diagram showing a state in which the display screen of a liquid crystal display device shown in FIG. 2 transits to a screen that allows the canvas size to be input, FIG. 3B is a schematic diagram showing a state in which a continuous line is input via the canvas on the liquid crystal display device, and FIG. 3C is a schematic diagram showing a state in which the display screen of the liquid crystal display device transits to a screen that allows the pitch length to be input.

FIG. 8A is an explanatory diagram for explaining an example in which a first candidate point is generated as an intermediate needle location point, and FIG. 8B is an explanatory diagram for explaining an example in which a second candidate point is generated as an intermediate needle location point.

DESCRIPTION OF THE PREFERRED EMBODIMENTS

Figure 2:
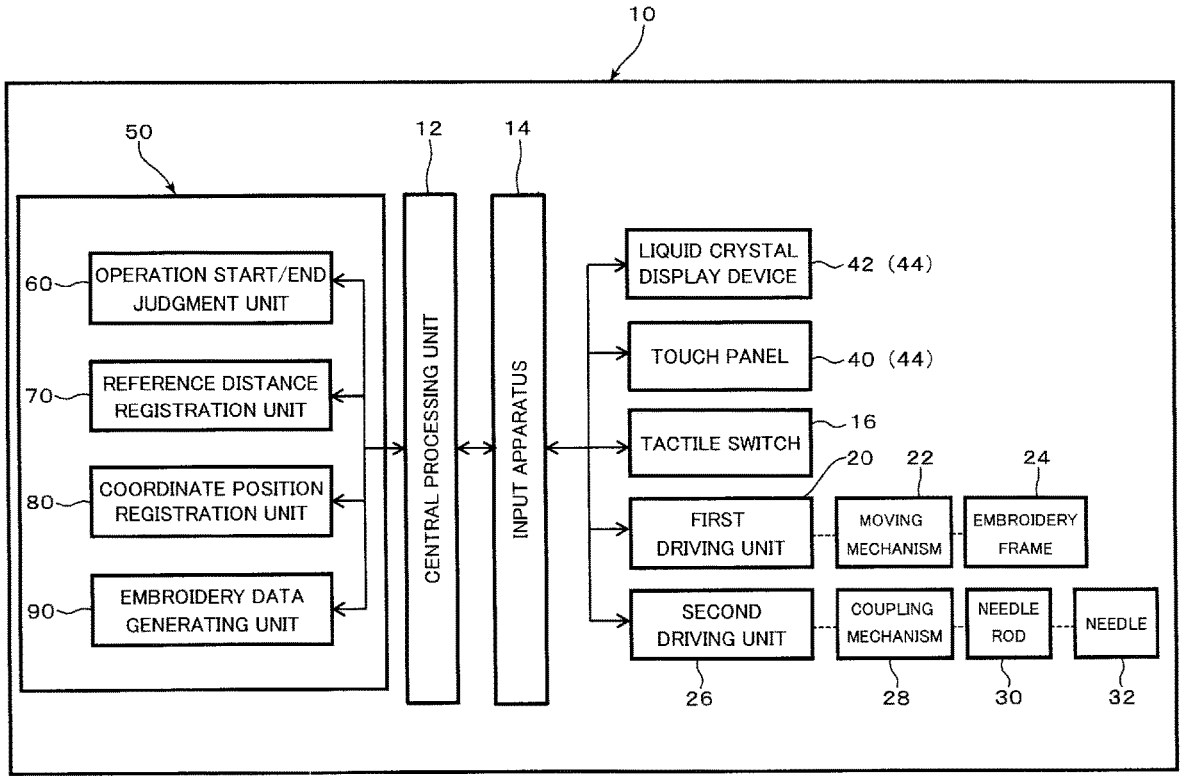
FIG. 2 is a configuration diagram showing a configuration of a sewing machine employing the embroidery data generating apparatus according to the present embodiment.

Description will be made below with reference to the drawings regarding a sewing machine 10 employing an embroidery data generating apparatus 50 according to the present embodiment. The sewing machine 10 is configured as a sewing machine that is capable of providing embroidery sewing. As shown in FIG. 2, the sewing machine 10 is configured including a tactile switch 16, a first driving unit 20 configured to drive an embroidery frame 24 such that it is moved, a second driving unit 26 configured to drive a needle rod 30 such that it is moved in the vertical direction, a touch panel 40, and a liquid crystal display device 42. Furthermore, the sewing machine 10 includes the embroidery data generating apparatus 50 configured to generate embroidery data to be used to perform embroidery sewing. Description will be made below regarding each component of the sewing machine 10.

The tactile switch 16 is electrically connected to a central processing unit (CPU) 12 via an input/output apparatus 14. By operating the tactile switch 16 via an unshown operating button, this arrangement allows the tactile switch 16 to output an output signal to the central processing unit 12. Specifically, by the user operating the operating button, this arrangement outputs a signal relating to a sewing operation such as a sewing start operation, sewing stop operation, a thread cutting operation, a threading operation, etc., to the central processing unit 12.

The first driving unit 20 includes two carriage motors electrically connected to the central processing unit 12 via the input/output apparatus 14. Furthermore, the carriage motors are mechanically coupled to a moving mechanism 22. The embroidery frame 24 is mounted on the moving mechanism 22. With such an arrangement, by means of the control operation of the central processing unit 12, this arrangement is capable of driving the carriage motors so as to drive the moving mechanism 22. This allows the moving mechanism 22 to move the embroidery frame 24 in the X direction (width direction of the sewing machine 10) and the Y direction (front-back direction of the sewing machine 10).

The second driving unit 26 includes a sewing machine motor. The sewing machine motor is electrically connected to the central processing unit 12 via the input/output apparatus 14. Furthermore, the sewing machine motor is coupled to the needle rod 30 via a coupling mechanism 28. A needle 32 is attached to a lower-end portion of the needle rod 30. With such an arrangement, by means of the control operation of the central processing unit 12, the sewing machine motor is driven. This operates the coupling mechanism 28 so as to move the needle rod 30 in the vertical direction, thereby providing a desired embroidery by means of the needle 32.

The touch panel 40 is configured as a touch panel employing an electrostatic capacitance method, a resistive film method, or the like. The touch panel 40 is electrically connected to the central processing unit (CPU) 12 via the input/output apparatus 14. Furthermore, the touch panel 40 is arranged such that it is exposed to the exterior of the sewing machine 10 so as to allow the user to operate the touch panel 40. The touch panel 40 is configured such that, when the user draws (inputs) a drawing (continuous line) on the touch panel 40 by means of the user's finger, a stylus, or the like, the touch panel 40 detects the coordinate positions of the continuous line thus input, and outputs the coordinate positions thus detected to the central processing unit 12. That is to say, the touch panel 40 is configured as a screen that allows a drawing to be input.

It should be noted that the touch panel 40 and the liquid display device 42 described later form part of the embroidery data generating apparatus 50 described later.

The liquid crystal display device 42 is electrically connected to the central processing unit (CPU) 12 via the input/output apparatus 14. The liquid crystal display device 42 is arranged as a lower layer such that the touch panel 40 is layered on the liquid crystal display device 42. The touch panel 40 and the liquid crystal display device 42 are integrated as a single unit, i.e., as a "display unit 44". The liquid crystal display device 42 is configured to provide correspondence between the coordinate position on the touch panel 40 and the coordinate position on the liquid crystal device 42. The liquid crystal display device 42 is configured to display the continuous line thus input, based on the data output to the central processing unit 12 from the touch panel 40.

Next, description will be made regarding the embroidery data generating apparatus 50, which is a main unit according to the present invention.

The embroidery data generating apparatus 50 is configured including the aforementioned display unit 44 (the touch panel 40 and the liquid crystal display device 42), an operation start/end judgment unit 60, a reference distance registration unit 70, a coordinate position registration unit 80, and an embroidery data generating unit 90.

The display unit 44 is configured to allow the user to operate so as to input (set) the size of a canvas in units of mm on which a drawing (continuous line) can be input. Specifically, the liquid crystal display device 42 displays a box B1 in which the user can input the width of the canvas CV, and a box B2 in which the user can input the height of the canvas CV. The display unit 44 is configured such that, when the user touches the touch panel 40 so as to input values in the boxes B1 and B2, the size of the canvas CV is set.

The embroidery data generating apparatus 50 is configured such that the central processing unit 12 calculates the size of the canvas CV based on the values input via the boxes B1 and B2, and the canvas CV is displayed on the liquid crystal display device 42 as shown in FIG. 3B. Specifically, the width and the height of the canvas CV are calculated in units of pixels using the following Expressions (1) and (2) based on the resolution (ppi: pixels per inch) of the liquid crystal display device 42 and the size (width and height (mm)) input via the boxes B1 and B2. The canvas CV thus defined is displayed on the liquid crystal display device 42.

$$\text{Width of canvas CV} = \text{Width input via box } B1 \text{ (mm)} / (25.4/\text{resolution (ppi)}) \quad \text{(Expression (1))}$$

$$\text{Height of canvas CV} = \text{Height input via box } B2 \text{ (mm)} / (25.4/\text{resolution (ppi)}) \quad \text{(Expression (2))}$$

This arrangement allows the user to input a continuous line CL on the touch panel 40 via the canvas CV displayed on the liquid display device 42 using the user's finger or a stylus.

[Operation Start/End Judgment Unit 60]

The operation start/end judgment unit 60 is electrically connected to the central processing unit 12. The operation start/end judgment unit 60 is configured to judge whether or not the input operation for the continuous line CL starts, and whether or not the input operation for the continuous line CL ends. Specifically, upon detecting a touch by the user's finger, a stylus, or the like on the touch panel 40, judgment is made that the input operation starts, and an output signal is output to the central processing unit 12. Furthermore, upon detecting a separation of the user's finger, a stylus, or the like from the touch panel 40, the operation start/end judgment unit 60 judges that the input operation ends, and outputs an output signal to the central processing unit 12.

[Reference Distance Registration Unit 70]

The reference distance registration unit 70 is electrically connected to the central processing unit 12. The reference distance registration unit 70 is configured to register the pitch length of the stitch (length of the stitch to be formed) specified by the user as a reference distance, and to output the pitch length represented in units of pixels to the central processing unit 12 as the reference distance L.

Specifically, when input of a continuous line ends according to an output signal to the central processing unit 12 from the operation start/end judgment unit 60 as described above, the central processing unit 12 instructs the liquid crystal display device 42 to display a display screen in order to prompt the user to input the pitch length (mm) as shown in FIG. 3C. In this screen, an increment (+) button and a decrement (−) button are displayed. By the user touching the increment button or otherwise the decrement button until the pitch length is set to the user's desired value, this arrangement allows the desired pitch length to be input (FIG. 3C shows an example in which the pitch length is set to 2.4 (mm)). After the user inputs the pitch length, the reference distance registration unit 70 performs calculation so as to convert the pitch length into the reference distance L in units of pixels using the following Expression (3). Furthermore, the reference distance registration unit 70 outputs the reference distance L to the central processing unit 12.

$$\text{Reference distance } L \text{ of pitch length in units of pixels} = \text{pitch length (mm)}/(25.4/\text{resolution (ppi)}) \quad \text{Expression (3)}$$

[Coordinate Position Registration Unit 80]

The coordinate position registration unit 80 is electrically connected to the central processing unit 12. The coordinate position registration unit 80 reads out the track of the input continuous line CL for every predetermined period of time or otherwise for every predetermined distance from the start of input. The coordinate position registration unit 80 acquires the points thus read out as track points A (see the solid circular dots shown in FIG. 4A). Furthermore, the coordinate position registration unit 80 registers the coordinate position of each of the track points A thus acquired such that they are associated with the order of input of the continuous line CL, and outputs the coordinate positions thus registered to the central processing unit 12. That is to say, the coordinate position registration unit 80 is configured to read out the continuous line CL thus input as multiple discrete track points A arranged on the input continuous line CL, and to register the coordinate positions of the track points A.

Figures 4A, 4B:
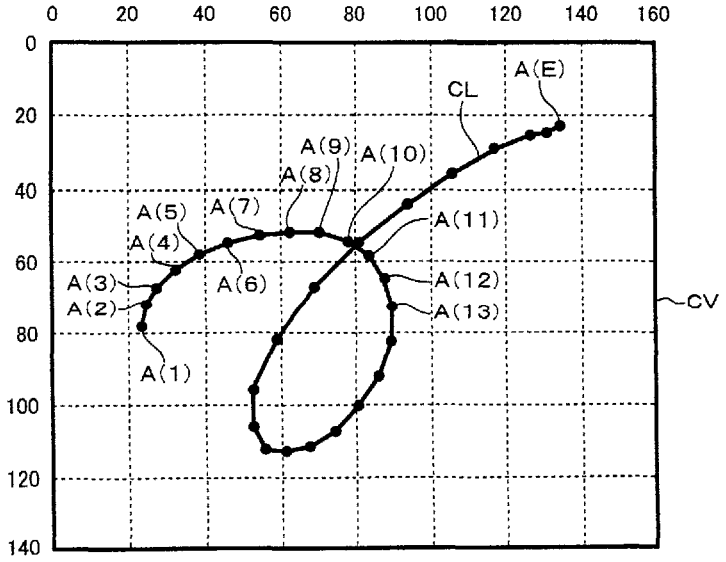
FIG. 4A is a schematic diagram showing track points on the continuous line shown in FIG. 3B.
FIG. 4B is a table showing an example of the coordinate positions of the track points shown in FIG. 4A.

More specifically, the coordinate position registration unit 80 reads out the start point of the continuous line CL as the first track point A(1). Subsequently, the coordinate position registration unit 80 reads out the track points A for every predetermined time or otherwise for every predetermined distance from the first track point A(1). Lastly, the coordinate position registration unit 80 reads out the end point of the continuous line CL as the last track point A(E). Furthermore, as shown in FIG. 4B, the coordinate position registration unit 80 registers the multiple track points A thus read out as a series of track points A sorted in input order, registers the coordinate position of each track point A as the coordinate data, and outputs the series of track points A to the central processing unit 12. It should be noted that FIG. 4A shows the canvas CV with the horizontal axis as the X axis and with the vertical axis as the Y axis. In FIGS. 4A and 4B, the number appended in parentheses for each track point A represents the number associated with the input order. The track point A(E) represents the end point of the track points A.

[Embroidery Data Generating Unit 90]

The embroidery data generating unit 90 is electrically connected to the central processing unit 12. The embroidery data generating unit 90 is configured to generate needle location points (points at which a stitch pattern is to be formed) based on the reference distance L registered by the reference distance registration unit 70 and the data of the multiple track points A registered by the coordinate position registration unit 80, and to generate a sequence and the coordinate positions of the needle location points as the embroidery data.

Specifically, the embroidery data generating unit 90 is configured to select a multiple number of particular track points A as reference track points, and to convert the track points A thus selected, such that they are sorted in input order at a pitch of the reference distance L. The embroidery data generating unit 90 generates the points thus converted as the needle location points.

Figures 1A, 1B:
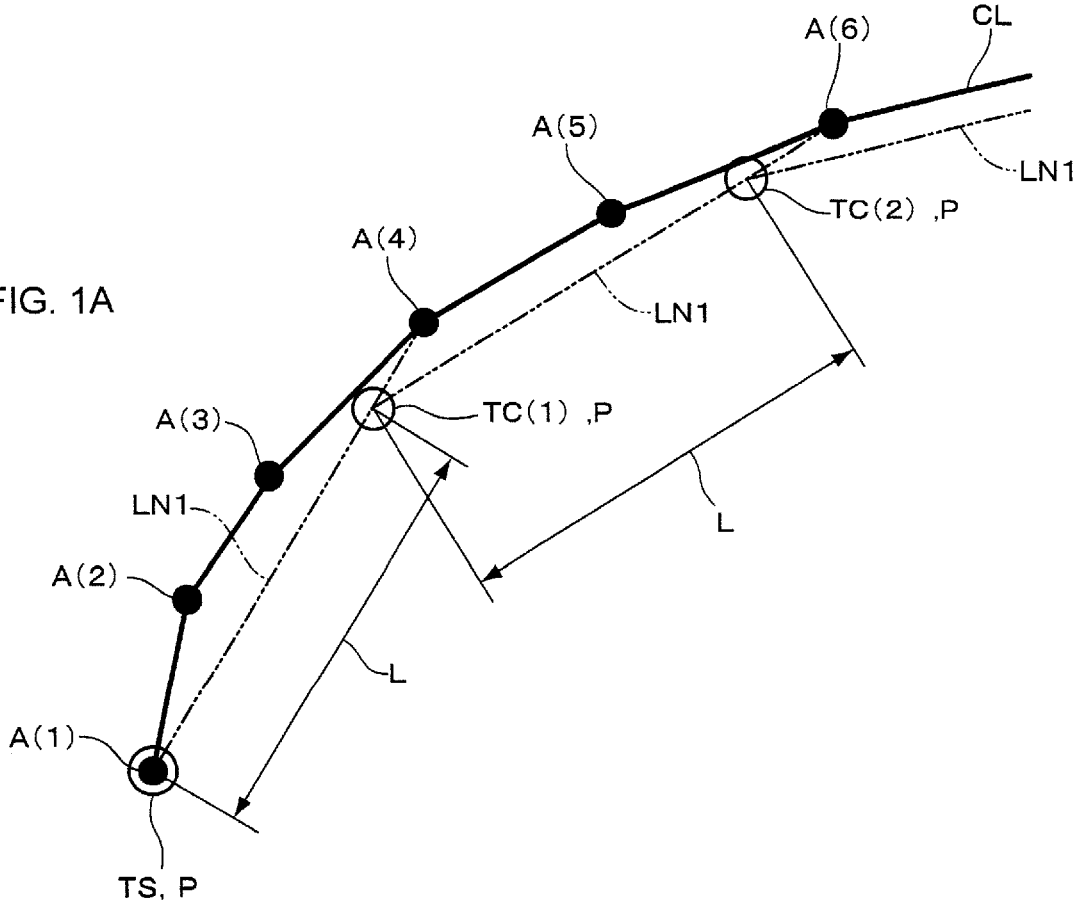
FIG. 1A is an explanatory diagram for explaining a sequence for generating needle location points to be generated by an embroidery data generating apparatus according to the present embodiment.
FIG. 1B is a table showing an example of the coordinate positions of the needle location points generated shown in FIG. 1A.

More specifically, as shown in FIG. 1A, the embroidery data generating unit 90 generates the first track point A(1) as a needle location start point TS (see the open circular dot in FIG. 1A) which is to be used as the start point of the needle location. Furthermore, the embroidery data generating unit 90 generates the track point A(E) (which is not shown in FIG. 1A) which is the last track point as the needle location end point TE (which is not shown in FIG. 1A) which is the end point of needle location. Furthermore, the embroidery data generating unit 90 performs the following processing for the track points A(2), . . . , arranged between the track points A(1) and A(E), so as to generate intermediate needle location points TC as the "needle location points" arranged between the needle location start point TS and the needle location end point TE.

That is to say, first, the embroidery data generating unit 90 sets the track point A(1) as the reference point P. Next, the embroidery data generating unit 90 calculates the distance between the reference point P and each track point A in ascending order of the track point A number. Furthermore, the embroidery data generating unit 90 compares the distance thus calculated with the reference distance L. When the calculated distance becomes equal to or greater than the reference distance L, the corresponding track point A (i.e., track point A of the smallest number from among the track points for which the corresponding calculated distance is equal to or greater than the reference distance L) is read out and set as a reference track point (in an example shown in FIG. 1A, the fourth track point A(4) is set as the reference track point).

Next, an imaginary line LN1 is defined such that it extends linearly from the reference point P to the track point A(4) thus selected. The embroidery data generating unit 90 generates a particular point on the imaginary line LN1 away from the track point A(1) by the reference distance L as the first intermediate needle location point TC(1) of the intermediate needle location points TC (see the open circular dots in FIG. 1A). That is to say, the embroidery data generating unit 90 is configured to convert the coordinate position of the track point A(4) thus selected as the reference track point. The the track point A(4) thus subjected to the coordinate conversion is generated as the intermediate needle location point TC(1). Furthermore, the embroidery data generating unit 90 generates the intermediate needle location point TC(1) as the first intermediate needle location point TC, generates the sequence data with respect to the sequential order number of the intermediate needle location point TC(1) and the coordinate data thereof, and registers the data thus generated.

It should be noted that the generation of the intermediate needle location point TC(1) described above can also be understood as follows. That is to say, a vector having a length that matches the reference length L and having a direction from the reference point P to the track point A(4) is defined. In this case, the end point of the vector thus defined may be set as the intermediate needle point TC(1) to be generated.

Furthermore, the embroidery data generating unit 90 sets the intermediate needle location point TC(1) thus generated as the updated reference point P. The aforementioned operations are sequentially performed for the track point A selected as the reference track point and the subsequent track points A (including the track point A selected as the reference track point), thereby generating the second intermediate needle location point TC(2). As described above, the embroidery data generating unit 90 repeatedly performs the aforementioned operations, thereby sequentially generating the intermediate needle location points TC. Furthermore, the embroidery data generating unit 90 generates the sequence data and the coordinate position data for each of the needle location start point, the intermediate needle location points TC, and the needle location end point TE, and outputs the sequence data and the coordinate position data thus generated to the central processing unit 12 as the embroidery data.

In this case, the distance between the end of the track point A(E) (needle location end point TC) on the continuous line and the last intermediate needle location point TC thus generated does not necessarily match the reference distance L. Accordingly, the embroidery data generating unit 90 performs end point processing such that the distance between the last intermediate needle location point TC and the needle location end point TE approaches the reference distance L.

Figure 5:
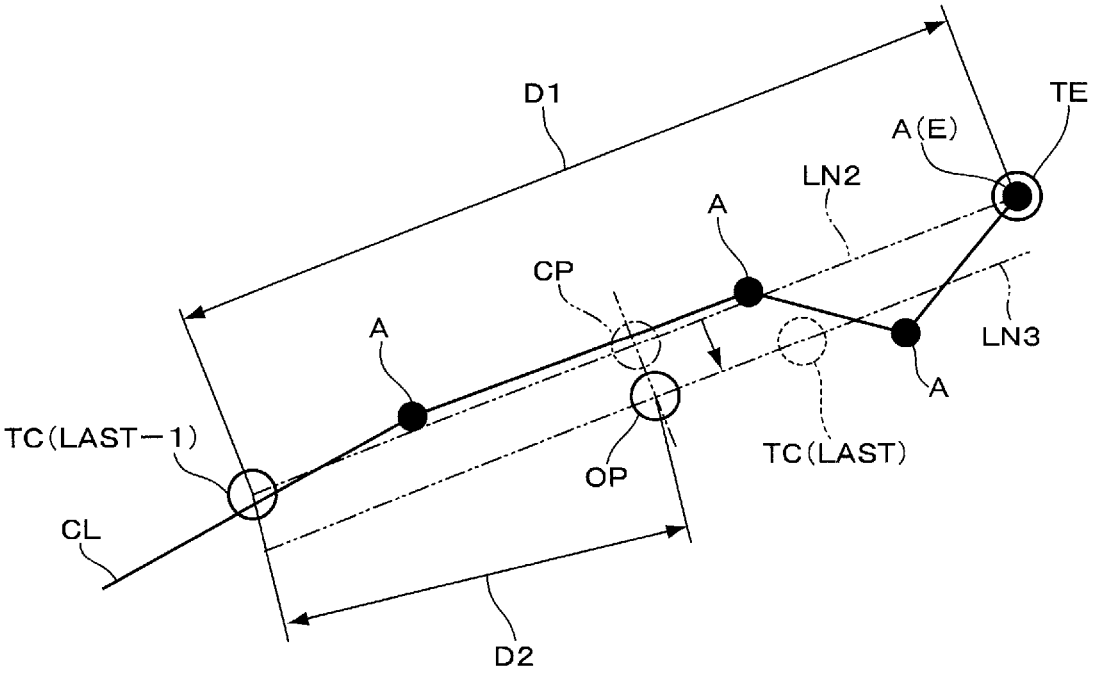
FIG. 5 is an explanatory diagram for explaining a sequence of end point processing executed by the embroidery data generating unit shown in FIG. 2.

Specifically, as shown in FIG. 5, the embroidery data generating unit 90 selects the last point from among the intermediate needle location points TC thus generated as the intermediate needle location point TC(LAST). Furthermore, the embroidery data generating unit 90 sets the intermediate needle location point immediately before the intermediate needle location point TC(LAST) as the intermediate needle location point TC(LAST-1).

Furthermore, an imaginary connection line LN2 is defined such that it extends linearly between the intermediate needle location point TC(LAST-1) and the needle location end point TE. Furthermore, an offset line LN3 is defined with an offset from the imaginary connection line LN2 up to the intermediate needle location point TC(LAST) in a direction that is orthogonal to the imaginary connection line LN2 (direction represented by the arrow shown in FIG. 5). In other words, the offset line LN3 is defined in parallel with the imaginary connection line LN2 such that it passes through the intermediate needle location point TC(LAST). Furthermore, the embroidery data generating unit 90 acquires the center point CP of the imaginary connection line LN2. The embroidery data generating unit 90 acquires an offset point OP on the offset line LN3 such that it is offset from the center point CP.

Furthermore, the embroidery data generating unit 90 calculates a first distance D1 between the intermediate needle location point TC(LAST-1) and the needle location end point TE and a second distance D2 between the intermediate needle location point TC(LAST-1) and the offset point OP. Next, the embroidery data generating unit 90 makes a comparison between the first distance D1 and the second distance D2. When the first distance D1 is closer to the reference distance L than the second distance D2, the intermediate needle location point TC(LAST) is deleted, and the intermediate needle location point TC(LAST-1) is determined as and set as the end point of the intermediate needle location TC. Conversely, when the second distance D2 is closer to the reference distance L than the first distance D1, the intermediate needle location point TC(LAST) is replaced by the offset point OP, thereby determining the intermediate needle location point TC(LAST). In other words, the embroidery data generating unit 90 converts (corrects) the coordinate position of the intermediate needle location point TC(LAST) to the coordinate position of the offset point OP, thereby determining the converted point as the intermediate needle location point TC(LAST).

As described above, the embroidery data generating unit 90 generates the needle location start point TS, the intermediate needle location points TC, and the needle location end point TE to be used to form a stitching pattern. The coordinate positions of the needle location points are generated as data. The needle location point data is represented in units of pixels in an absolute coordinate system on the canvas CV. Accordingly, the embroidery data generating unit 90 converts the coordinate position data of the needle location points into coordinate position data represented in units of mm on an embroidery frame 24. The embroidery data generating unit 90 outputs the data thus converted to the central processing unit 12. With such an arrangement, the central processing unit 12 is configured to drive the first driving unit 20 and the second driving unit 26 based on the coordinate position data of the needle location points thus subjected to the coordinate conversion into a coordinate system represented in units of mm, thereby providing an embroidery to the embroidery target.

[Actions and Effects]

Next, description will be made regarding the operation of the embroidery data generating apparatus 50 with reference to the flowcharts shown in FIGS. 6 and 7. Furthermore, description will be made regarding the actions and effects of the present embodiment.

Figure 6:
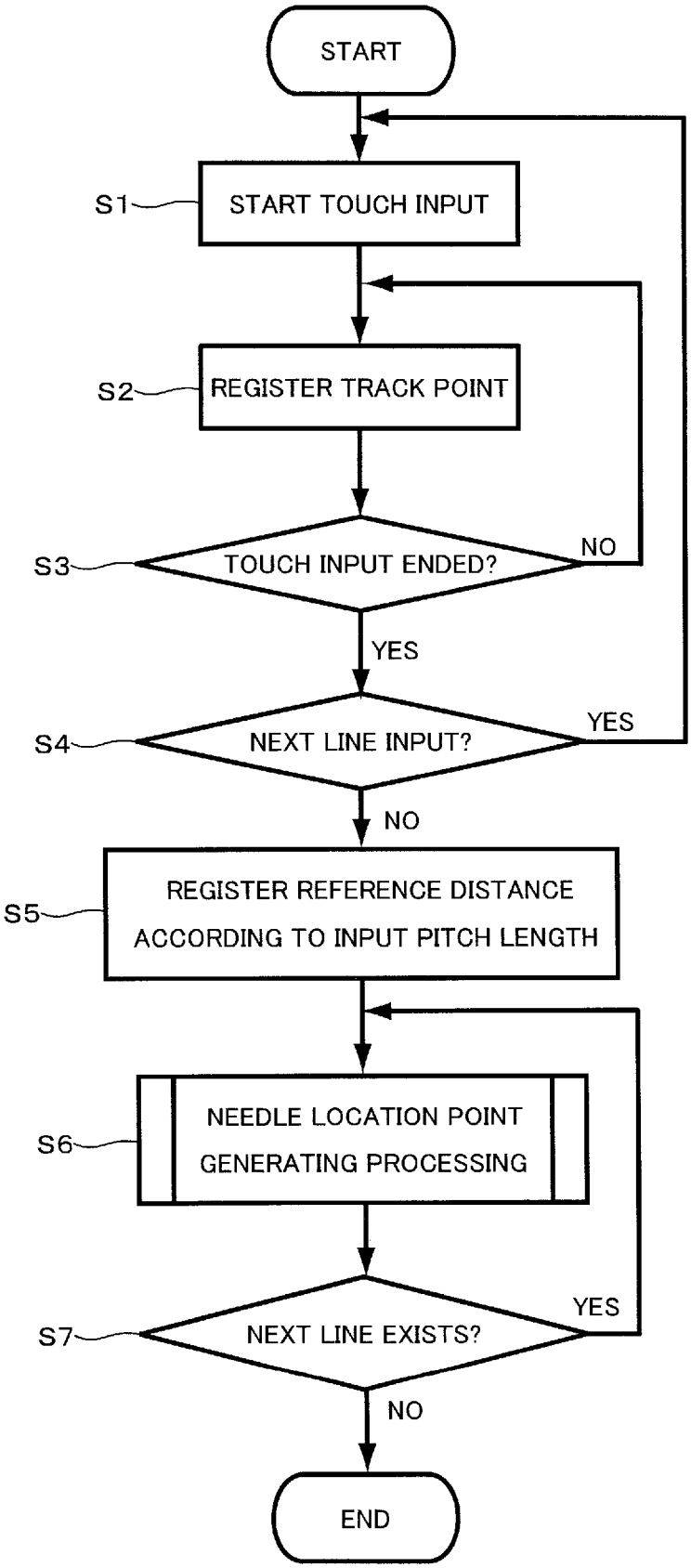
FIG. 6 is a flowchart showing the operation of the embroidery data generating apparatus.

As shown in FIG. 6, with the embroidery data generating apparatus 50, when the user starts the input of a desired continuous line (drawing) on the canvas CV using the user's finger, a stylus, or the like, in Step 1 (S1), the operation start/end judgment unit 60 detects that the finger, the stylus, or the like, has touched the touch panel 40, and judges that the input of the continuous line CL has started.

When the input of the continuous line CL has started, in Step 2 (S2), the coordinate position registration unit 80 reads out the coordinate position of each track point A of the input continuous line CL for every predetermined time or otherwise for every predetermined distance. Furthermore, the coordinate position registration unit 80 registers the track points A in input order as the sequence data. Moreover, the coordinate position registration unit 80 registers the coordinate position of each track point A as the coordinate position data.

Subsequently, in Step 3 (S3), the operation start/end judgment unit 60 judges whether or not the input of the continuous line CL has ended. When judgement has been made that the input has not ended, the flow returns to Step 2. In this case, the coordinate position registration unit 80 repeatedly performs the registration of the coordinate position data of the track points A. Conversely, when the operation start/end judgment unit 60 judges that the input of the continuous line CL has ended, the coordinate position registration unit 80 registers the coordinate position of the track point A(E) configured as the end point of the continuous line CL, following which the flow transits to Step 4 (S4).

In Step 4, this arrangement prompts the user to input the next continuous line CL. When the user has input the next continuous line CL, the flow returns to Step 1, and the continuous line CL is input. Conversely, when the user has not input the next continuous line CL, the flow transits to Step 5 (S5).

In Step 5, the display screen on the liquid crystal display device 42 is switched to a screen that prompts the user to input the pitch length. When the user inputs the pitch length, the reference distance L is registered. When the reference distance L has been registered in Step 5, the flow transits to Step 6 (S6).

In Step 6, the embroidery data generating unit 90 executes generation of the needle location points. The embroidery data generating unit 90 generates the sequence data and the coordinate position data with respect to the needle location points thus generated as the embroidery data. The embroidery data generating unit 90 outputs the embroidery data thus generated to the central processing unit 12.

When the generation of embroidery data for the continuous line CL has ended in Step 6, the flow transits to Step 7 (S7). In Step 7, the embroidery data generating unit 90 judges whether or not a different continuous line CL remains. When judgment has been made that there is a remaining different continuous line CL, the flow returns to Step 6. In this case, the embroidery data generating unit 90 generates the embroidery data for such a different continuous line CL, and outputs the embroidery data thus generated to the central processing unit 12. Conversely, when judgment has been made that there is no remaining different continuous line CL, the operation ends.

Next, description will be made with reference to FIG. 7 regarding a needle location point generating operation performed in Step 6 by the embroidery data generating unit 90.

Figure 7:
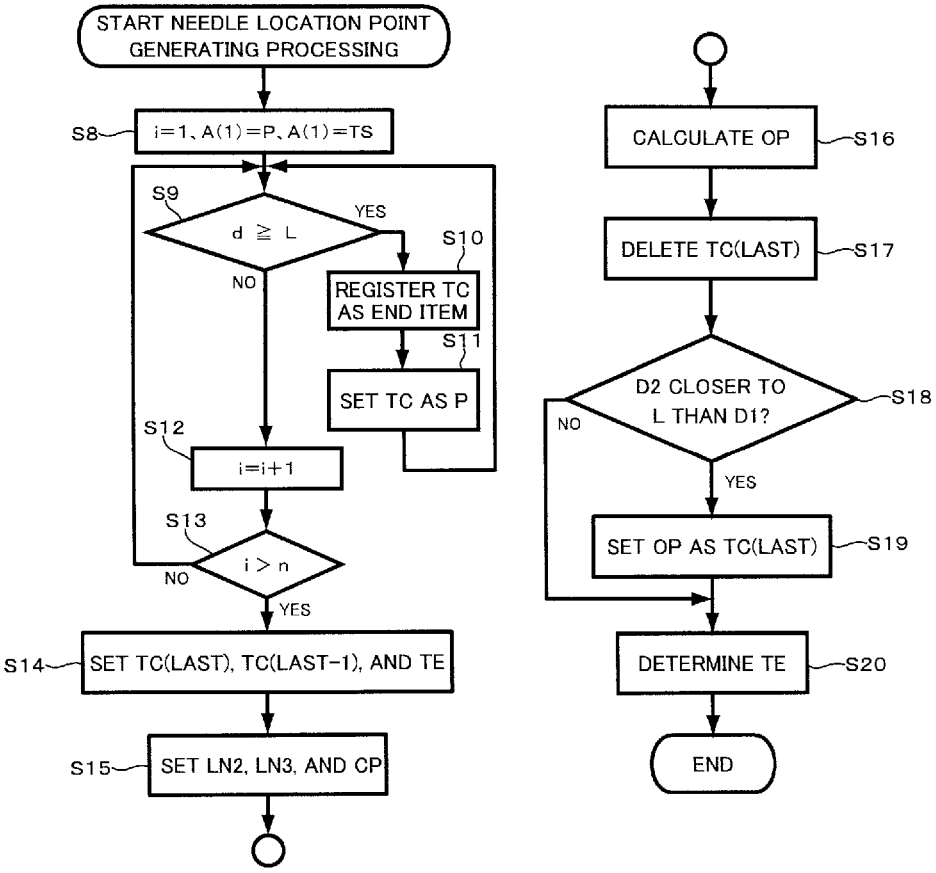
FIG. 7 is a flowchart showing a flow of needle location point generating processing performed by the embroidery data generating unit included in the embroidery data generating apparatus.

It should be noted that "i" shown in FIG. 7 represents the number associated with the input order in the input operation for the track points A, "n" represents the number of track points A registered by the coordinate position registration unit 80, and "d" represents the distance between the reference point P and the track point A(i).

As shown in this drawing, when the generation of the needle location points has been started, in Step 8 (S8), "i" is set to "1", and the track point A(1) is set as the reference point P. Furthermore, the track point A(1) is determined as the needle location start point TS, and the sequence data and the coordinate position data is generated for the needle location start point TS. After the processing in Step 8, the flow transits to Step 9 (S9).

In Step 9, judgement is made whether or not the distance d between the reference point P and the track point A(i) is equal to or greater than the reference distance L. For example, in Step 9 immediately after the processing performed in Step 8, "i" is set to "1". Accordingly, the distance d is the distance between the reference point P and the track point A(1). That is to say, the distance d is "0". When the distance d is smaller than the reference distance L, the flow transits to Step 12 (S12).

In Step 12, the number "i" is incremented by 1, i.e., is set to "i+1", following which the flow transits to Step 13 (S13). For example, in Step 9 immediately after the processing performed in Step 8, "i" is set to "1" as described above, and accordingly, the distance d is zero. In this case, the flow transits to Step 12, and "i" is incremented to "2", following which the flow transits to Step 13.

In Step 13, magnitude comparison is made between the number "i" thus incremented and "n", which is the number of the track points A that have been registered. When the incremented number "i" is equal to or smaller than "n", the flow returns to Step 9. In this case, judgment is made regarding whether or not the distance d between the reference point P and the track point A(i) thus incremented is equal to or greater than the reference distance L. That is to say, the distance d between the reference point P and each track point A(i) is compared with the reference length L in ascending order of the numbers "i". Conversely, when the incremented number "i" is larger than "n", this means that there is no next track point A. In this case, the flow transits to Step 14 (S14), that is to say, the flow transits to the end point processing.

With such an arrangement, in the aforementioned Step 9, when the distance d is equal to or greater than the reference distance L, the flow transits to Step 10 (S10). In Step 10, the track point A(i) for which the distance d becomes equal to or greater than the reference distance L is extracted as the reference track point. After the determination of the reference track point, an imaginary line LN1 is defined such that it extends from the reference point P to the track point A(i) thus extracted. The coordinate position of a particular point on the imaginary line LN1 away from the reference point P by the reference distance L is read out. Furthermore, the coordinate position of the track point A(i) thus extracted is converted into the coordinate position thus read out. The track point A(i) thus subjected to coordinate position conversion is registered as the intermediate needle location point TC, i.e., as the end item of the intermediate needle location points TC.

After the processing in Step 10, the flow transits to Step 11 (S11). In Step 11, the intermediate point TC thus registered as the end is set as the updated reference point P. After the setting of the updated reference point P, the flow returns to Step 9. Subsequently, the aforementioned processing is repeatedly performed for the track points A each having a number that is larger than that of the track point A(i) used as the reference track point, thereby sequentially generating multiple intermediate needle location points TC. That is to say, it can also be understood that, in the processing in Steps 10 and 11, a particular point on the imaginary line LN1 away from the reference point P by the reference distance L is set as the updated reference point P, and the updated reference point P is registered as the end of the intermediate needle location points TC.

Conversely, in Step 13, when "i" is larger than "n", the flow transits to Step 14 (S14). In this case, the end point processing is executed. In Step 14, the last point of the intermediate needle location points TC thus generated is set as the intermediate needle location point TC(LAST). Furthermore, a particular intermediate needle location point TC thus generated immediately before the last point of the intermediate needle location points TC is set as the intermediate point TC(LAST-1). Moreover, the last track point A(E) from among the track points A is generated as the needle location end point TE. After the processing in Step 14, the flow transits to Step 15 (S15).

In Step 15, the imaginary connection line LN2 is defined such that it extends linearly between the intermediate needle location point TC(LAST-1) and the needle location end point TE. Furthermore, the offset line LN3 is defined with an offset from the imaginary connection line LN2 up to the center point TC(LAST) in a direction that is orthogonal to the imaginary connection line LN2. Moreover, the center point CP of the imaginary connection line LN2 is calculated. After the processing in Step 15 ends, the flow transits to Step 16 (S16).

In Step 16, the offset point OP is calculated such that it is offset from the center point CP of the imaginary connection line LN2 up to the offset line LN3. After the processing in Step 16, the flow transits to Step 17 (S17).

In Step 17, the intermediate needle location point TC(LAST) thus generated is temporarily deleted. After the processing in Step 17, the flow transits to Step 18 (S18).

In Step 18, the first distance D1 between the intermediate needle location point TC(LAST-1) and the needle location end point TE and the second distance D2 between the intermediate needle location point TC(LAST-1) and the offset point OP are calculated. Furthermore, a comparison is made between the first distance D1 and the second distance D2. When the first distance D1 is closer to the reference distance L than the second distance D2, the flow transits to Step 20 (S20).

In Step 20, the needle location end point TE thus generated is determined, and the processing ends. That is to say, as a result, in the processing in Steps 17, 18, and 20, the intermediate needle location point TC(LAST-1) is determined as the updated intermediate needle location point TC(LAST).

Conversely, when judgement is made in Step 18 that the second distance D2 is closer to the reference distance L than the first distance D1, the flow transits to Step 19 (S19). In Step 19, the offset point OP is set as the updated intermediate needle location position TC(LAST), thereby determining the intermediate needle location position TC(LAST). That is to say, in the processing in Step 17, S18, and S19, as a result, the coordinate position of the intermediate needle location point TC(LAST) before deleting is converted (corrected) to the coordinate position of the offset point OP, and the point thus converted is determined as the intermediate needle location point TC(LAST). After the processing in Step 19, the flow transits to Step 20. In this step, the needle location end point thus generated is determined, following which the operation ends.

As described above, with the embroidery data generating apparatus 50 according to the present embodiment, the track of the continuous line CL input via the touch panel 40 is determined for every predetermined time or otherwise for every predetermined distance. The coordinate position registration unit 80 registers multiple points thus detected as the track points A in input order. Furthermore, the coordinate position registration unit 80 registers the coordinate position for each track point A. The embroidery data generating unit 90 generates the start point of the continuous line CL (i.e., first track point A(1)) as the needle location start point TS. Furthermore, the embroidery data generating unit 90 generates the end point of the continuous line CL (i.e., last track point A(E)) as the needle location end point TE. Moreover, the embroidery data generating unit 90 selects appropriate points from among the multiple track points A that are subsequent to the first track point A(1). The embroidery data generating unit 90 converts the coordinate position of each of the track points A thus selected, so as to generate the intermediate needle location points TC. With such an arrangement, the coordinate position data of the needle location points thus generated (needle location start point TS, intermediate needle location points TC, and needle location end point TE) are generated as the embroidery data.

The track points A, from among which the reference track points are selected, are registered such that they are associated with the input order of the continuous line CL. This arrangement allows the needle location points thus generated (needle location start point TS, intermediate needle location points TC, and needle location end point TE) to be registered such that they are associated with the input order of the continuous line CL. By using the embroidery data generated by the embroidery data generating apparatus 50, this arrangement is capable of forming an embroidery in the same order as the input order of the continuous line CL. In particular, in a case in which the continuous line CL has a crossing portion, in the crossing portion, the portion of the continuous line CL input at a later timing in the input order is arranged on an upper side of the portion of the continuous line CL input at an earlier timing. Thus, this arrangement is capable of faithfully reproducing the input continuous line CL. Accordingly, the embroidery data generating apparatus 50 is capable of generating the embroidery data so as to provide an embroidery according to a design as intended by the user.

As described above, the embroidery data generating apparatus 50 acquires the track points A on the continuous line CL, and generates the needle location points based on the track points A thus acquired. That is to say, the embroidery data generating apparatus 50 handles the continuous line CL as discrete track points A arranged on the continuous line CL. The embroidery data generating apparatus 50 generates the needle location points based on the track points A, so as to generate the embroidery data. This allows the embroidery data generating apparatus 50 to perform the embroidery data generating processing with an increased operation speed.

The embroidery data generating apparatus 50 selects a start point of the continuous line CL as a reference point P. Furthermore, the embroidery data generating apparatus 50 sequentially performs a comparison operation for each distance d between the reference point P and the corresponding track point A in the order of registration of the track points A. The first track point A for which the distance d becomes longer than the reference distance L is selected as the reference track point. Furthermore, an imaginary line LN1 is defined such that it extends from the reference point P up to the reference track point thus selected. A particular point on the imaginary line LN1 away from the reference point P by the reference distance L is defined and generated as the intermediate needle location point TC. Accordingly, the intermediate needle location point TC is generated between the reference point P and the reference track point thus selected. This allows each needle location point TC to be arranged in the canvas VC in a sure manner.

Furthermore, with the embroidery data generating apparatus 50, as described above, the end point processing is performed after Step S14. The end point processing is performed such that the distance between the intermediate needle location point TC(LAST) and the needle location end point TE approaches the reference distance L. By performing the end point processing, this arrangement is capable of performing an operation such that the distance between the intermediate needle location point TC(LAST) and the needle location end point TE approaches the reference distance L even if the distance between the intermediate needle location point TC(LAST) and the needle location end point TE does not match the reference distance L.

Furthermore, with the embroidery data generating apparatus 50, as described above, the first track point A(1) is generated as the needle location start point TS, and the last track point A(E) is generated as the needle location end point TE. That is to say, the needle location points are generated along the input continuous line CL from the start point up to the end point. This allows the embroidery data to be generated along the input continuous line CL.

Furthermore, with the embroidery data generating apparatus 50, after the coordinate registration unit 80 acquires the track points A at predetermined intervals, the reference distance registration unit 70 registers the pitch length. This allows a desired pitch length to be registered regardless of the predetermined intervals at which the track points A are acquired.

[Modification of Needle Location Point Generating Processing by Embroidery Data Generating Apparatus 90]

Description has been made in the aforementioned embodiment regarding an arrangement in which a single particular reference track is selected so as to generate an intermediate needle location point TC. Description will be made in the present modification regarding an arrangement in which two particular reference track points are selected so as to generate such an intermediate needle location point TC.

Figure 8A:
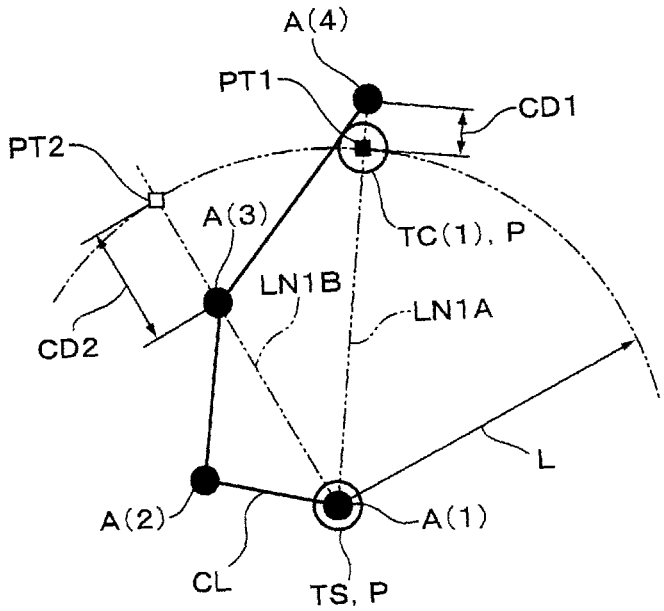
FIGS. 8A and 8B are explanatory diagrams for explaining a needle point generating sequence provided by a modification of the needle location point generating processing performed by the embroidery data generating apparatus, and specifically.
Figure 8B:
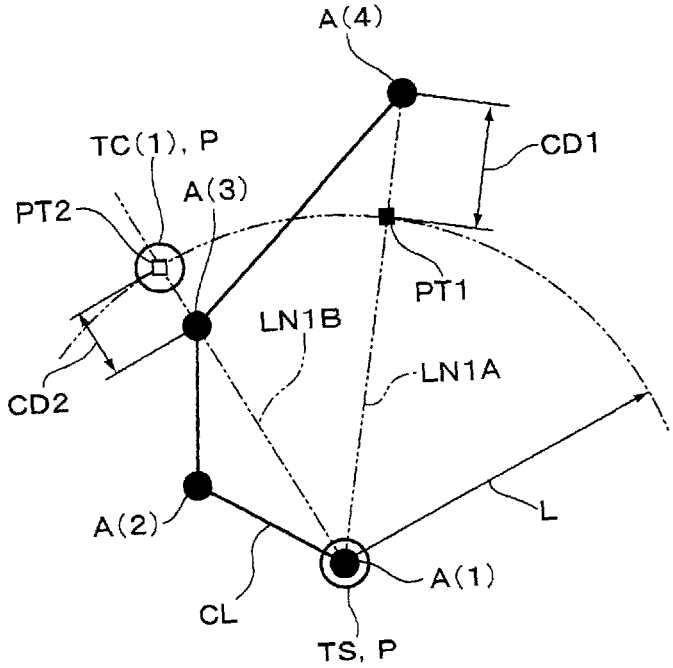

That is to say, as shown in FIGS. 8A and 8B, when the distance between the reference point P and the track point A(i) becomes longer than the reference distance L, the corresponding track point A(i) is selected as a first reference track point (in the examples shown in FIGS. 8A and 8B, the track point A(4) is selected as the first reference track point). Furthermore, with the modification, the track point A(i−1), which is a track point that is immediately before the track point A(i) for which the distance becomes longer than the reference distance L, is selected as a second reference point (in the examples shown in FIGS. 8A and 8B, the track point A(3) is selected as the second reference track point).

Furthermore, a first imaginary line LN1A is defined such that it extends from the reference point P up to the track point A(i) thus selected as the first reference track point. A particular point on the first imaginary line LN1A away from the reference point P by the reference distance L is defined as a first candidate point PT1 (see the dot represented by the solid rectangular symbol in FIGS. 8A and 8B).

Moreover, a second imaginary line LN1B is defined such that it extends from the reference point P up to the track point A(i−1) thus selected as the second reference track point. A particular point on the second imaginary line LN1B away from the reference point P by the reference distance L is defined as a second candidate point PT2 (see the dot represented by the open rectangular symbol in FIGS. 8A and 8B).

Furthermore, the distance between the first candidate point PT1 and the track point A(i) selected as the first reference track point is calculated as a first candidate distance CD1. Moreover, the distance between the second candidate point PT2 and the track point A(i−1) selected as the second reference track point is calculated as a second candidate distance CD2.

Subsequently, comparison is made between the first candidate distance CD1 and the second candidate distance CD2. When the first candidate distance CD1 is smaller than the second candidate distance CD2, the first candidate point PT1 is generated as the intermediate needle location point TC. That is to say, in the example shown in FIG. 8A, the first candidate point PT1 generated based on the track point A(4) is generated as the intermediate needle location point TC(1).

Conversely, when the second candidate distance CD2 is smaller than the first candidate distance CD1, the second candidate point PT2 is generated as the intermediate needle location point TC. That is to say, in the example shown in FIG. 8B, the second candidate point PT2 generated based on the track point A(3) is generated as the intermediate needle location point TC(1).

Subsequently, regardless of the examples shown in FIGS. 8A and 8B, after the generation of the intermediate needle location point TC(1), the intermediate location point TC(1) thus generated is set as the updated reference point P. Furthermore, the aforementioned processing is performed for the track points A that are subsequent to the track point A(4), thereby sequentially generating the intermediate needle location points TC.

As described above, with the present embodiment, two reference track points are selected, and the first candidate point PT1 and the second candidate point PT2 are acquired. Furthermore, comparison is made between each of the distances from the first candidate point PT1 and the second candidate point PT2 up to the two respective reference track points, so as to generate the intermediate needle location point TC. This allows the intermediate needle location point TC thus generated to be arranged at a position in the vicinity of the continuous line CL. That is to say, this allows each intermediate needle location point TC to be arranged along the continuous line CL. Thus, such an arrangement is capable of effectively providing an embroidery according to a design as intended by the user.

Figure 9A:
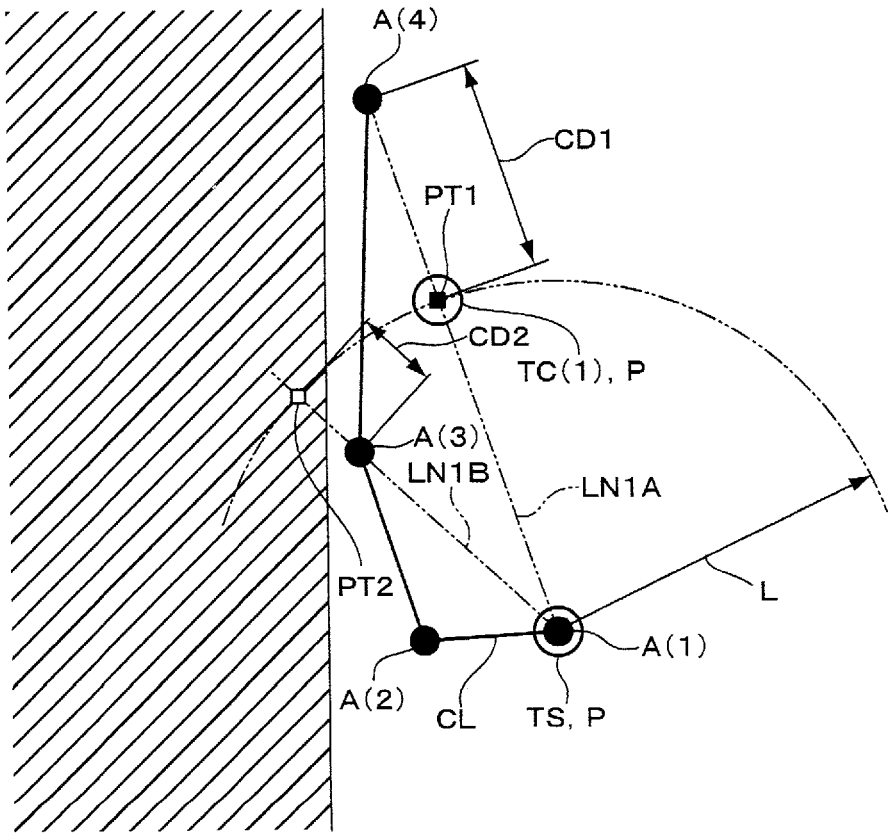
FIG. 9A is an explanatory diagram for explaining generation of the intermediate needle location point when the first candidate point is positioned outside the canvas, which is employed in a modification of the needle location generating processing performed by the embroidery data generating apparatus.

It should be noted that, with the aforementioned modification, when the second candidate point PT2 is generated as the intermediate needle location point TC, the intermediate needle location point TC (second candidate point PT2) is arranged in a region that is opposite to the reference point P across the continuous line CL. That is to say, in some cases, as shown in FIG. 9A, the intermediate needle location point TC (second candidate point PT2) thus generated is arranged in a region outside the canvas CV (hatched region in FIG. 9A). In order to solve such a problem, in this case, the first candidate point PT1 may be generated as the intermediate needle location point TC. Also, the intermediate needle location point TC thus generated may be set as the updated reference point P so as to sequentially generate the subsequent intermediate needle location points TC.

In some cases, in the step in which the first reference track point and the second reference track point are selected, the second reference track point cannot be selected. That is to say, in some cases, the distance from the reference point P up to the track point A(i) is equal to or greater than the reference distance L. In this case, only the first reference track point may be selected so as to generate the intermediate needle location point TC. Description will be made below with reference to FIG. 9B regarding this point.

Figure 9B:
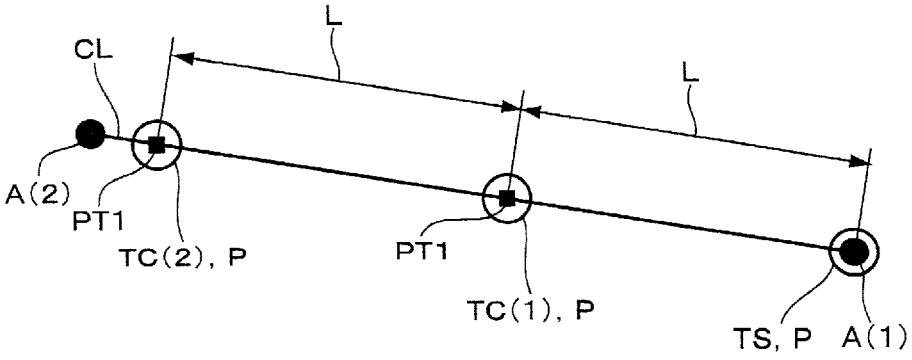
FIG. 9B is an explanatory diagram for explaining generation of the intermediate needle location point when the second reference point cannot be selected in the present modification.

That is to say, in the example shown in FIG. 9B, the distance between the track point A(1) and the track point A(2) is longer than twice the reference distance L. In this case, first, the track point A(1) is generated as the needle location start point TS. At the same time, the track point A(1) is set as the reference point P. The point for which the distance between the reference point P and the track point A becomes equal to or greater than the reference distance L is the track point A(2). Accordingly, the track point A(2) is selected as the first reference track point. Furthermore, a first imaginary line LN1A (not shown) is defined such that it extends from the reference point P up to the track point A(2). In this stage, the track point A(1) that is immediately before the track point A(2) selected as the first reference point is generated (registered) as the needle location start point TS. Accordingly, in this case, only the first reference track point is selected. Subsequently, a particular point on the first imaginary line LN1A away from the reference point P by the reference distance L is generated as the intermediate needle location point TC(1) (first candidate point PT1). Furthermore, the intermediate needle location point TC(1) thus generated is set as the updated reference point P.

After the setting of the updated reference point P, the distance between the reference point and the track point A(2) is calculated. In this stage, the distance thus calculated is equal to or greater than the reference distance L. Accordingly, the track point A(2) is selected as the first reference track point. Furthermore, the first imaginary line LN1A (not shown) is defined such that it extends from the reference point P up to the track point A(2). As with the case described above, the track point A(1) that is immediately before the track point A(2) selected as the first reference track point is generated (registered) as the needle location start point TS. Accordingly, only the first reference track point is selected. Furthermore, a particular point on the imaginary line LN1A away from the reference point P by the reference distance L is generated as the intermediate needle location point TC(2) (first candidate point PT1). The intermediate needle location point TC(2) thus generated is set as the updated reference point P.

As described above, when the second reference track point cannot be selected in a step in which the first reference track point and the second reference track point are selected, only the first reference track point is selected. Such an arrangement allows the generation of each needle intermediate point TC to be continued.

Furthermore, with the aforementioned modification, two reference track points (the first reference track point and the second reference track point) are selected from among the track points A. The first candidate point PT1 and the second candidate point PT2 are acquired based on the two reference track points thus selected. The first candidate point PT1 or otherwise the second candidate point PT2 is generated as the intermediate needle location point TC. Instead of such an arrangement, the second candidate point PT2 may always be generated as the intermediate needle location point TC. With such an arrangement, the first candidate point PT1 may be generated as the intermediate needle location point TC only when the second candidate point PT2 is positioned in a region outside the canvas CV or otherwise the second reference point cannot be selected.

Description has been made in the present embodiment and the modification regarding an arrangement in which the first track point A(1) is generated as the needle location start point TS, and the last track point A(E) is generated as the needle location end point TE. Also, desired track points may be generated as the needle location start point TS and the needle location end point TE. For example, the N-th track point A(N) may be generated as the needle location start point TS, and the (N+M)-th track point A(N+M) may be generated as the needle location end point TE, according to the user's input. In this case, the coordinate registration unit 80 may register the N-th track point A(N) as the updated first track point A(l) of the track points A. Also, the coordinate registration unit 80 may register the (N+M)-th track point A(N+M) as the updated last track point A(E) of the track points A. In this state, the embroidery data generating unit 90 may generate the needle location points. This arrangement is capable of generating the embroidery data in a desired range of the input continuous line CL.

Description has been made in the present embodiment and the modification regarding an arrangement in which the coordinate position registration unit 80 detects the track points A of the continuous line CL for every predetermined time or otherwise for every predetermined distance. However, the detection of the track points A is not restricted to such an arrangement. For example, the kind of intervals at which the track points A are detected may be selected from among the predetermined time and the predetermined distance according to the input situation of the continuous line CL. Also, the track points A may be detected at predetermined intervals of the predetermined time or otherwise the predetermined distance. This allows the track points A to be detected with high precision.

That is to say, in a case in which the track points A are detected for every predetermined time, when the continuous line CL is input at a relatively low input speed, this arrangement has the potential to fail to detect the track points A with high precision. On the other hand, in a case in which the track points A are detected for every predetermined distance, each track point is detected based on a Euclidean distance in a coordinate system. However, when a complicated drawing or a fine drawing is input, this arrangement has the potential to fail to detect the track points A with high precision. In contrast, by selectively using the kind of intervals from among the predetermined time and the predetermined distance, or by using any one of the kind of intervals from among the predetermined time and the predetermined distance, this arrangement supports various kinds of drawings, thereby detecting the track points A with high precision.

Description has been made in the present embodiment and the modification regarding an arrangement in which the embroidery data generating apparatus 50 is built into the sewing machine 10. Also, the sewing machine 10 and the embroidery data generating apparatus 50 may be configured as separate units. In this case, the embroidery data generating apparatus 50 may be provided with a control unit electrically connected to the components of the embroidery data generating apparatus 50 (the display unit 44, the operation start/end judgment unit 60, the reference distance registration unit 70, the coordinate position registration unit 80, and the embroidery data generating unit 90). Also, the control unit may be configured to control such components. Also, in this case, the sewing machine 10 may be connected to the embroidery data generating apparatus 50 in a wired manner or otherwise in a wireless manner, such that the embroidery data generated by the embroidery data generating apparatus 50 is output to the sewing machine 10.

It should be noted that the operation of the embroidery data generating apparatus 50 may be recorded on a computer system-readable recording medium in the form of a program. Also, such a program thus recorded on the recording medium may be read out and executed by the embroidery data generating apparatus 50, thereby providing the embroidery data generating apparatus 50 according to the present invention. Examples of such a computer system as used here include an OS and a hardware component such as peripheral devices or the like.

Also, the "computer system" encompasses website providing environments (or display environments) that employ the WWW (World Wide Web) system. Also, the aforementioned program may be transmitted to other computer systems from a given computer system that stores this program in its storage apparatus or the like via a transmission medium or otherwise transmission waves in the transmission medium. The "transmission medium" as used here to transmit a program represents a medium having a function of transmitting information, examples of which include networks (communication networks) such as the Internet and communication lines (communication wires) such as phone lines, etc.

Also, the aforementioned program may be configured to provide a part of the aforementioned functions. Also, the aforementioned program may be configured as a so-called differential file (differential program), which is to be combined with a different program stored beforehand in a computer system in order to provide the aforementioned functions.

DESCRIPTION OF THE REFERENCE NUMERALS

10 sewing machine, 12 central processing unit, 14 input/output apparatus, 16 tactile switch, 20 first driving unit, 22 moving mechanism, 24 embroidery frame, 26 second driving unit, 28 coupling mechanism, 30 needle rod, 32 needle, 40 touch panel, 42 liquid crystal display device, 44 display unit (display portion), 50 embroidery data generating apparatus, 60 operation start/end judgment unit, 70 reference distance registration unit, 80 coordinate position registration unit, 90 embroidery data generating unit, A track point, A(E) last track point, B1 box, B2 box, CD1 first candidate distance, CD2 second candidate distance, CL continuous line, CP center point, CV canvas, D1 first distance, D2 second distance, L reference distance, LN1 imaginary line, LN1A first imaginary line, LN1B second imaginary line, LN2 imaginary connection line, LN3 offset line, OP offset point, P reference point, PT1 first candidate point, PT2 second candidate point, TC intermediate needle location point (needle location point), TC(LAST) last intermediate needle location point, TC(LAST-1) intermediate needle location point that is immediately before the last intermediate needle location point, TE needle location end point (needle location point), TS needle location start point (needle location point).

What is claimed is:

1. An embroidery data generating apparatus configured to generate needle location points for forming a stitching pattern based on an input continuous line, the embroidery data generating apparatus comprising:

a coordinate position registration unit that registers coordinate positions of a plurality of track points detected at predetermined intervals from a track of a continuous line input via a screen, such that they are associated with an input order of the track points;

a reference distance registration unit that registers a stitching pitch length as a reference distance; and an embroidery data generating unit configured to generate a desired one of the track points on the continuous line as a needle location start point which is a start point of a needle location, to select particular track points as reference track points from among the plurality of track points that have been input after the track point thus generated as the needle location start point, to convert the coordinate positions of the reference track points such that the reference track points are arranged in the input order from the needle location start point at intervals of the reference distance, to generate the converted points as needle location points, and to generate data of the needle location points thus generated as embroidery data, wherein the embroidery data generating unit sets the needle location start point as a reference point, and registers a distance between the reference point and each of the track points in a registration order of the track points, wherein the embroidery data generating unit selects, as the reference track point, a first one of the track points when the distance becomes longer than the reference distance or otherwise the track point that is immediately before the first track point, wherein the embroidery data generating unit generates, as the needle location point, a particular point on an imaginary line defined such that it extends from the reference point up to the reference track point such that the particular point is positioned away from the reference point by the reference distance, and wherein the embroidery data generating unit sets the needle location point thus generated as the updated reference point, and repeatedly generates the subsequent needle location points.

2. The embroidery data generating apparatus according to claim 1, wherein the embroidery data generating unit sets the needle location start point as a reference point, and registers a distance between the reference point and each of the track points in a registration order of the track points, wherein the embroidery data generating unit selects, as a first reference track point, a first one of the track points when the distance between the reference point and the track point becomes longer than the reference distance, and selects, as a second reference track point, a track point that is immediately before the first reference track point, wherein the embroidery data generating unit acquires, as a first candidate point, a particular point on a first imaginary line defined such that it extends from the reference point up to the first reference track point such that the particular point is positioned away from the reference point by the reference distance, and calculates a first candidate distance between the first reference track point and the first candidate point, wherein the embroidery data generating unit acquires, as a second candidate point, a particular point on a second imaginary line defined such that it extends from the reference point up to the second reference track point such that the particular point is positioned away from the reference point by the reference distance, and calculates a second candidate distance between the second reference track point and the second candidate point, wherein, when the first candidate distance is shorter than the second candidate distance, the embroidery data generating unit generates the first candidate point as the needle location point, wherein, when the second candidate distance is shorter than the first candidate distance, the embroidery data generating unit generates the second candidate point as the needle location point, and wherein the embroidery data generating unit sets the needle location point thus generated as the updated reference point, and repeatedly generates the subsequent needle location points.

3. The embroidery data generating apparatus according to claim 2, comprising a display unit including the screen configured to allow the continuous line to be input, and configured to set a size of a canvas via which the continuous line is input according to an operation, and wherein, when the second candidate point is arranged at a position outside the canvas, the first candidate point is generated as the needle location point.

4. The embroidery data generating apparatus according to claim 1, wherein the coordinate position registration unit registers a start point of the continuous line as the first track point, and registers an end point of the continuous line as the last track point, and wherein the embroidery data generating unit generates the first track point as the needle location start point, and generates the last track point as the needle location end point which is an end point of the needle location.

5. The embroidery data generating apparatus according to claim 1, wherein the kind of the predetermined intervals is at least one from among a predetermined time and a predetermined distance.

6. An embroidery data generating method for generating needle location points for forming a stitching pattern based on an input continuous line, the embroidery data generating method comprising:

registering in which a coordinate position registration unit registers coordinate positions of a plurality of track points detected at predetermined intervals from a track of a continuous line input via a screen, such that they are associated with an input order of the track points;

registering in which a reference distance registration unit registers a stitching pitch length as a reference distance; and generating in which an embroidery data generating unit generates a desired one of the track points on the continuous line as a needle location start point which is a start point of a needle location, selects particular track points as reference track points from among the plurality of track points that have been input after the track point thus generated as the needle location start point, converts the coordinate positions of the reference track points such that the reference track points are arranged in input order from the needle location start point at intervals of the reference distance, generates the converted points as needle location points, and generates data of the needle location points thus generated as embroidery data, generating in which an embroidery data generating unit sets the needle location start point as a reference point, and registers a distance between the reference point and each of the track points in a registration order of the track points, generating in which an embroidery data generating unit selects, as the reference track point, a first one of the track points when the distance becomes longer than the reference distance or otherwise the track point that is immediately before the first track point, generating in which an embroidery data generating unit generates, as the needle location point, a particular point on an imaginary line defined such that it extends from the reference point up to the reference track point such that the particular point is positioned away from the reference point by the reference distance, and generating in which an embroidery data generating unit sets the needle location point thus generated as the updated reference point, and repeatedly generates the subsequent needle location points.

7. A non-transitory recording medium that stores a program to be used to instruct a computer of an embroidery data generating apparatus configured to generate needle location points for forming a stitching pattern based on an input continuous line, to execute:

registering in which a coordinate position registration unit registers coordinate positions of a plurality of track points detected at predetermined intervals from a track of a continuous line input via a screen, such that they are associated with an input order of the track points;

registering in which a reference distance registration unit registers a stitching pitch length as a reference distance; and generating in which an embroidery data generating unit generates a desired one of the track points on the continuous line as a needle location start point which is a start point of a needle location, selects particular track points as reference track points from among the plurality of track points that have been input after the track point thus generated as the needle location start point, converts the coordinate positions of the reference track points such that the reference track points are arranged in input order from the needle location start point at intervals of the reference distance, generates the converted points as needle location points, and generates data of the needle location points thus generated as embroidery data, generating in which an embroidery data generating unit sets the needle location start point as a reference point, and registers a distance between the reference point and each of the track points in a registration order of the track points, generating in which an embroidery data generating unit selects, as the reference track point, a first one of the track points when the distance becomes longer than the reference distance or otherwise the track point that is immediately before the first track point, generating in which an embroidery data generating unit generates, as the needle location point, a particular point on an imaginary line defined such that it extends from the reference point up to the reference track point such that the particular point is positioned away from the reference point by the reference distance, and generating in which an embroidery data generating unit sets the needle location point thus generated as the updated reference point, and repeatedly generates the subsequent needle location points.

* * * * *